US011540067B2

(12) United States Patent
Nielsen et al.

(10) Patent No.: US 11,540,067 B2
(45) Date of Patent: Dec. 27, 2022

(54) COMPACT, WATERTIGHT AND ACOUSTICALLY-TIGHT BUTTON STRUCTURE

(71) Applicant: GN Hearing A/S, Ballerup (DK)

(72) Inventors: Henrik Nielsen, Roskilde (DK); Søren Davids, Jyllinge (DK); Thomas John Chappell, Evanston, IL (US)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 17/080,799

(22) Filed: Oct. 26, 2020

(65) Prior Publication Data

US 2021/0152959 A1 May 20, 2021

(30) Foreign Application Priority Data

Nov. 15, 2019 (EP) ..... 19209321

(51) Int. Cl.
*H04R 25/00* (2006.01)
*H04R 1/08* (2006.01)

(52) U.S. Cl.
CPC ..... *H04R 25/65* (2013.01); *H04R 1/083* (2013.01); *H04R 2225/61* (2013.01)

(58) Field of Classification Search
CPC ... H04R 1/02; H04R 9/06; H04R 1/08; H04R 9/08
USPC ..... 381/333–335, 355, 361, 369, 388
See application file for complete search history.

(56) References Cited

U.S. PATENT DOCUMENTS 4,719,322 A * 1/1988 Guzik ..... H04B 1/086 181/141
5,280,146 A 1/1994 Inagaki et al.
5,463,692 A * 10/1995 Fackler ..... H04R 25/65 200/11 R
5,687,242 A 11/1997 Iburg et al.
(Continued)

FOREIGN PATENT DOCUMENTS

CN 108 769 889 11/2018
DE 2914954 10/1980
(Continued)

OTHER PUBLICATIONS

Written Opinion and International Search Report for PCT/EP2020/081907, dated Jan. 27, 2021.
(Continued)

*Primary Examiner* — Suhan Ni
(74) *Attorney, Agent, or Firm* — Vista IP Law Group, LLP

(57) ABSTRACT

A button structure for a hearing device, includes: a first microphone, the first microphone being configured to receive sound via a first microphone input; an elastic member comprising a first part and a second part, the first part comprising a user interface surface, the second part comprising a first opening, the first opening being aligned with the first microphone input; a switch component, wherein the user interface surface is configured to be operated by a user to activate the switch component; and an outer shielding comprising a shield opening and a second opening, wherein at least a portion of the first part of the elastic member extends through the shield opening, wherein the second opening of the outer shield is aligned with the first opening of the second part of the elastic member, and wherein the outer shielding is in contact with the elastic member to create a seal.

33 Claims, 4 Drawing Sheets

(56) References Cited

U.S. PATENT DOCUMENTS

| | | | | |
|---|---|---|---|---|
| 6,936,783 | B2 | 8/2005 | Kawaguchi et al. | |
| 6,984,799 | B2 | 1/2006 | Kawaguchi et al. | |
| 7,355,137 | B2 | 4/2008 | Kawasaki et al. | |
| 8,693,201 | B2 * | 4/2014 | Yamazaki | H01H 13/705 361/748 |
| 2004/0129542 | A1 | 7/2004 | Kawaguchi et al. | |
| 2007/0034493 | A1 | 2/2007 | Kawasaki et al. | |
| 2009/0252976 | A1 | 10/2009 | Hyuga | |
| 2017/0215013 | A1 * | 7/2017 | Tan | H04R 25/603 |
| 2018/0190445 | A1 | 7/2018 | Ito et al. | |

FOREIGN PATENT DOCUMENTS

| | | |
|---|---|---|
| DE | 3711789 | 10/1988 |
| EP | 0483898 | 5/1992 |
| EP | 0674330 | 9/1995 |
| EP | 1233436 | 8/2002 |
| EP | 1496530 | 1/2005 |
| EP | 3407629 | 11/2018 |
| JP | 2007-287496 | 11/2007 |
| KR | 2008 0002764 | 7/2008 |
| WO | WO 03/049495 | 6/2003 |
| WO | WO 2017/056273 | 4/2017 |

OTHER PUBLICATIONS

European search report for EP application No. 19209321.9, dated Jan. 7, 2020.

* cited by examiner

COMPACT, WATERTIGHT AND ACOUSTICALLY-TIGHT BUTTON STRUCTURE

RELATED APPLICATION DATA

This application claims priority to, and the benefit of, European Patent Application No. 19209321.9 filed on Nov. 15, 2019. The entire disclosure of the above application is expressly incorporated by reference herein.

FIELD

The present disclosure relates generally to a compact, watertight and acoustically-tight button structure particularly suitable for a compact hearing device such as a custom hearing aid.

BACKGROUND

The components of hearing devices such as e.g. headsets, headphones, earphones, hearing aids etc. are exposed to an array of potentially damaging substances during use. Examples of such potentially damaging substances are humidity, grease, perspiration and earwax. Therefore, the components, particularly the electronic components, of hearing devices are shielded to some degree from these substances.

Shielding is even more relevant for so-called custom hearing devices such as e.g. Invisible-in-Canal (IIC), Completely-in-Canal (CIC), In-the-Canal (ITC), or In-the-Ear (ITE) hearing aids, which reside partially or fully within the ear canal, which is a damp environment containing earwax.

An issue for many hearing devices with respect to shielding is that they have one or more user interfaces, such as push-buttons, toggle switches, or volume control, to allow the user to change various settings. Such user interfaces often require one or more openings in the outer shielding, which then become possible entry points for humidity, grease, etc. Further, the user interface means that part of the hearing device is regularly directly exposed to a user's fingers, which may contain substances such as fluids or grease thus adding to the exposure.

In addition to shielding from humidity and grease, the hearing device will often also need to be acoustically-tight such that no sound or as little sound as possible enters, for example via openings in the shielding. Most hearing devices seek to close off sound from the outside such that any sound they produce is better heard. For example, sophisticated hearing aids analyse the incoming sound and suppress undesired ones, such as impulse sounds, while enhancing desired sounds, such as speech; If incoming sounds are able to travel through the shielding this functionality is reduced.

A challenge in the design of button structures suitable for hearing devices, in particular those suitable for custom hearing aids, is the small form factor and compactness required, which means that components in the hearing device have to be positioned closely together.

There is therefore a need for a compact, watertight and acoustically-tight button structure that alleviates one or more of the above mentioned drawbacks at least to some extent.

SUMMARY

It is an object to alleviate at least one or more of the above mentioned drawbacks at least to an extent.

An aspect of one or more embodiments is defined in claim 1.

Accordingly, in a first aspect, a compact, watertight and acoustically-tight button structure is provided, where the structure comprises:

- a first microphone, which is adapted to receive incoming sound via a first microphone input.
- an elastic member, which has a main part and a protruding part. The main part has a user interface surface and the protruding part has a first opening. The first opening in the protruding part is positioned such that it is aligned with the first microphone input.
- a switch component, which is positioned such that a user can activate the switch component by engaging with the user interface surface of the elastic member.
- an outer shielding, which has a shield opening and a second opening. The outer shielding is positioned such that the main part of the elastic member extends partly through the shield opening and such that the second opening is aligned with the first opening. Further, the outer shielding is in tight contact with the elastic member so as to create a watertight and acoustically-tight seal.

That the openings are aligned means that they overlap wholly or partially. By aligning the openings, sound is able to travel from outside the structure to the microphone via the openings. Thus, the openings fully extend through the solid materials to allow the sound to travel. By watertight is meant that the seal is of such tight construction or fit as to be impermeable to water except when under sufficient pressure to produce structural discontinuity. For most hearing devices this means that they will be able to withstand average humidity and light rain, but many devices may encounter problems with water entering the structure when exposed to high humidity, heavy rain, and/or heavy perspiration.

By acoustically-tight is meant that the seal between the elastic member and the outer shielding is impenetrable for sound except under extreme conditions. This means that no sound or as little sound as possible enters at the seal, which is necessary as most hearing devices seek to close off sound from outside such that any sound they may produce is better heard. For example, sophisticated hearing aids analyse the incoming sound and suppress undesired ones, such as impulse sounds, while enhancing desired sounds, such as speech; If impulse sounds are able to travel through the seal this functionality is reduced.

The elastic member may be made from a soft and compliant elastic material, such as a silicone polymer or a soft plastic elastomer. This has several advantageous effects, for example that a soft and compliant elastic material reduces noise due to handling and is pleasant to the touch.

The protruding part of the elastic member may be very thin, and even so thing that it is a thin film extending from the main part. The thickness of the protruding part may be as little as 0.1 mm. The protruding part is both a part of the seal and further acts to take up tolerance, when a user applies pressure to the button structure.

In an embodiment, the main part is made of a first elastic material and the protruding part is made of a second elastic material, and the first and second elastic materials have different properties, such as different hardness. In a further embodiment, the first elastic material has a higher value of hardness than the second elastic material. The switch component may be e.g. a push-button switch or a toggle switch or any other suitable type of switch component. The switch component is the element, which allows the user to change a setting of the hearing device. For example, a user may wish to turn a functionality on or off, switch between functionalities or increase/decrease a value, such as e.g. volume. The switch component may comprise one or more switch interface surfaces, which is the activation surface, i.e. the surface that, when engaged, causes the switch component to register a wish to change a setting. If the switch component is a push-button switch it is activated by pressure being applied to the switch interface surface. If the switch component is a toggle switch, a toggle must be moved in order for the switch component to change setting and the toggle will have two opposing switch interface surfaces.

The elastic member may also comprise more than one main part such that the button structure can accommodate for example two separate push-buttons, or a toggle switch and a push button, or a separate push-button and two related push-buttons used for volume control. This may require obvious appropriate additional features to the button structure, such as e.g. extra openings in the outer shielding. Generally, the elastic member has a dual function of being part of the seal and acting as actuator for the button functionality. In an embodiment, the main part of the elastic member further comprises a contact surface, the switch component comprises a switch interface surface, and when a force is applied by a user at the user interface surface, the contact surface of the elastic member moves in a direction towards the switch interface surface and, if sufficient force is applied, the contact surface causes the switch interface surface to be engaged. The outer shielding may be made from one or more plastics, metals, composites or other suitable materials. In a custom hearing aid the outer shielding is part of the outermost layer protecting the components of the hearing aid from the environment it is in, which often comprises moisture, ear wax, grit, etc.

The tight contact between the outer shielding and the elastic member may be created by e.g. fixation, gluing or soldering. If by fixation the elastic member is held in place between the underlying structure and the outer shielding by pressure.

In an embodiment, the button structure further comprises:

- a second microphone, which is adapted to receive incoming sound via a second microphone input.
- the protruding part comprises a third opening and the third opening is positioned such that it is aligned with the second microphone input.
- the outer shielding comprises a fourth opening and the fourth opening is aligned with the third opening.

The button structure may also comprise more than two microphones. In this case, each microphone will have a microphone input, the protruding part will comprise an opening that is aligned with the microphone input and the outer shielding will comprise an opening that is aligned with the opening in the protruding part.

In another embodiment, the button structure further comprises:

- a second microphone, which is adapted to receive incoming sound via a second microphone input, the second microphone input being aligned with an opening in the protruding part and an opening in the outer shielding so as to allow sound to travel from outside the button structure to the second microphone input.

A second microphone, and optionally any additional microphones, may share openings such that e.g. a single opening in the protruding part, which is aligned with an opening in the outer shielding, could allow sound to travel sound to travel to two or more microphones.

The first, and any additional, microphone may be mounted on a first PCB surface of a first printed circuit board (PCB). The first PCB will comprise a first microphone PCB opening that is aligned with the first microphone input and the first opening in the protruding part. Again, by aligning all openings, sound is able to travel from outside the structure to the microphone via the openings.

In an embodiment, the switch component is mounted on a second PCB surface, which is opposite the first PCB surface.

In an embodiment, the elastic member is fixated between the second PCB surface and the outer shielding by pressure. In another embodiment, which may be combined with fixation of the elastic member by pressure, the elastic member is glued to the outer shielding and/or the underlying surface.

In an embodiment, the extent, such as the diameter, of each of the aligned openings is 0.2 mm-2 mm, such as 0.2 mm-1.2 mm, such as 0.2 mm-0.8 mm.

In an embodiment comprising both a first and a second microphone, the distance between the first and the second microphone may be as little as 3 mm.

In a second aspect, a head-wearable hearing device adapted for use in, or at, an ear of a user is provided, where the hearing device comprises a watertight and acoustically-tight button structure as described in the first aspect.

The head-wearable hearing device may be a headset, headphone, earphone, or hearing aid.

The head-wearable hearing device may be a custom hearing aid.

DETAILED DESCRIPTION

Figure 1:
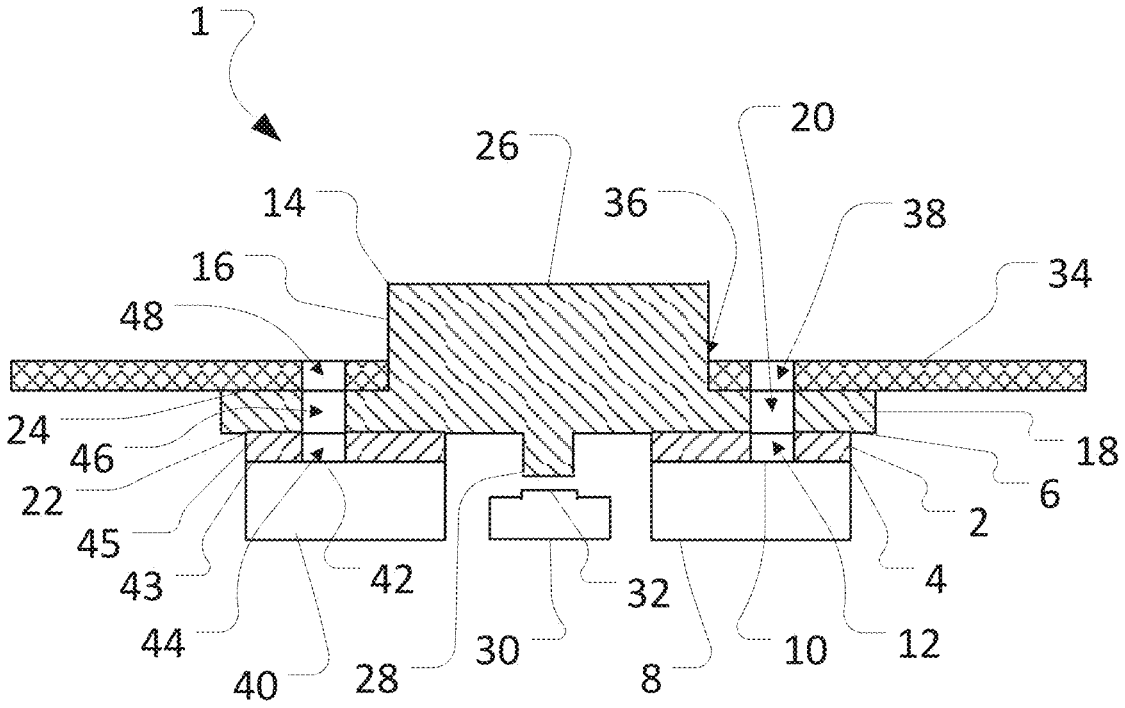
FIG. 1 schematically illustrates an embodiment of a compact, watertight and acoustically-tight button structure.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Various aspects and embodiments of a compact, watertight and acoustically-tight button structure for a hearing device as disclosed herein will now be described with reference to the figures.

FIG. 1 schematically illustrates an embodiment of a compact, watertight and acoustically-tight button structure 1 as a cross-section. The button structure shown in FIG. 1 comprises a first printed circuit board (PCB) 2, which has a first PCB surface 4 and an opposing second PCB surface 6. On the first PCB surface 4 is mounted a first microphone 8, which is adapted to receive incoming sound via a first microphone input 10. The first PCB 2 has a first microphone PCB opening 12, which is aligned with the first microphone input 10 allowing the first microphone 8 to receive sound through the first microphone input 10.

The button structure has an elastic member 14, which has a main part 16 and a protruding part 18. A first opening 20 in the protruding part 18 is positioned such that it is aligned with the first microphone input 10 and the first microphone PCB opening 12 allowing the first microphone 8 to receive sound through the first microphone input 10.

The protruding part 18 has a first protruding surface 22 and an opposing second protruding surface 24 and the protruding part 18 extends from the main part 16 of the elastic member with at least part of the first protruding surface 22 being in contact with part of the second PCB surface 6.

The main part 16 of the elastic member 14 has a user interface surface 26 and a contact surface 28. The contact surface 28 is opposite the user interface surface 26 and is at a distal end of a part of the elastic member 14, which extends from the main part 16.

A push-button switch component 30, having a switch interface surface 32 is positioned such that when a force is applied by a user at the user interface surface 26, the contact surface 28 of the elastic member 14 moves in a direction towards the switch interface surface 32 and, if sufficient force is applied, the contact surface 28 engages the switch interface surface 32 to activate the switch component 30.

An outer shielding 34 having a shield opening 36 and a second opening 38 is positioned such that the main part 16 of the elastic member 14 extends partly through the shield opening 36 and such that the second opening 38 is aligned with the first opening 20, the first microphone PCB opening 12, and the first microphone input 10 allowing the first microphone 8 to receive sound through the first microphone input 10.

The outer shielding 34 is in tight contact with the elastic member 14 so as to create a watertight and acoustically-tight seal of the button structure 1 such that the aligned openings 12, 20, 38 are the only way, except under extreme conditions, for water and sound to enter via the button structure 1. The microphone input 10 and/or one or more of the openings 12, 20, 38 allowing sound to travel to the microphone input 10 may be fitted with appropriate filters to keep out dirt and other substances from the aligned openings 10, 20, 38 and the microphone input 10.

The embodiment shown in FIG. 1 has a second microphone 40, which is adapted to receive incoming sound via a second microphone input 42. The second microphone 40 is mounted on a third PCB surface 43, which may be the same surface as that on which the first microphone 8 is mounted. To allow the second microphone 40 to receive sound via the second microphone input 42, the second PCB 45, on which the second microphone 40 is mounted, has a second microphone PCB opening 44, which is aligned with the second microphone input 42. The second PCB 45 may be the same as the first PCB. The protruding part 18 of the elastic member 14 has a third opening 46, which is positioned such that it is aligned with the second microphone input 42 and the outer shielding has a fourth opening 48, which is aligned with the third opening 46. By having the second microphone input 42, second microphone PCB opening 44, third opening 46 and fourth opening 48 aligned the second microphone 40 can receive sound via its input 42 and the aligned openings 44, 46, 48.

Figure 2A:
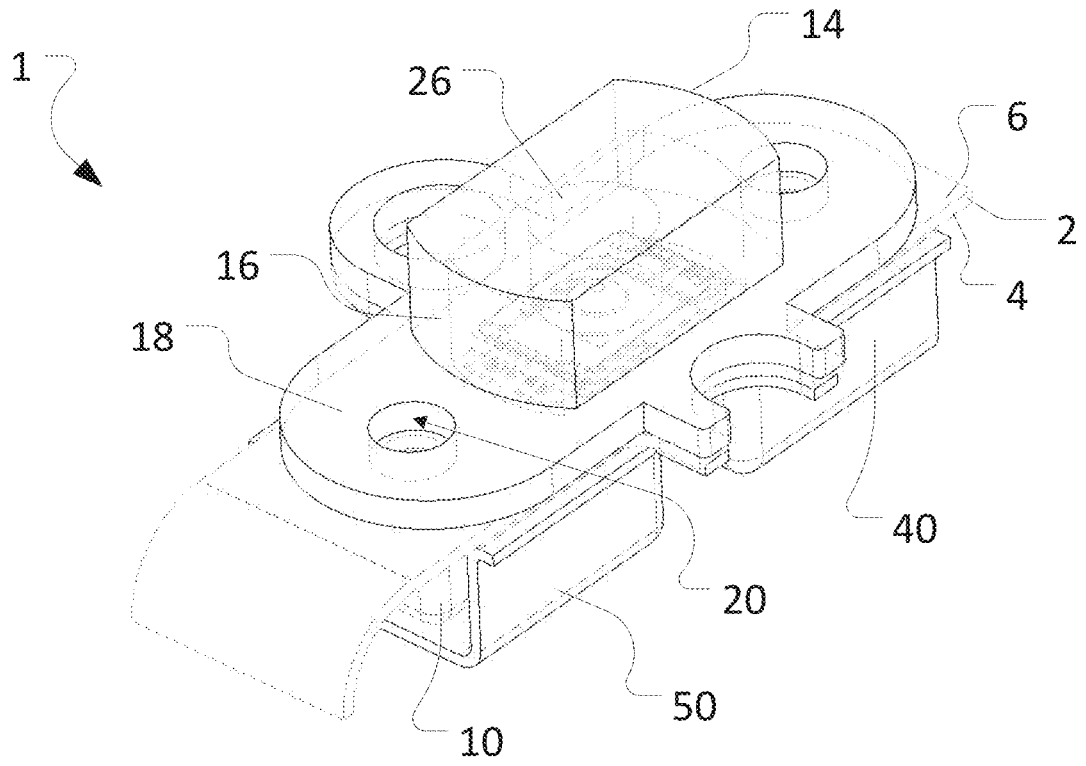
FIG. 2A is a perspective view schematically illustrating another embodiment of a compact, watertight and acoustically-tight button structure.
Figure 2B:
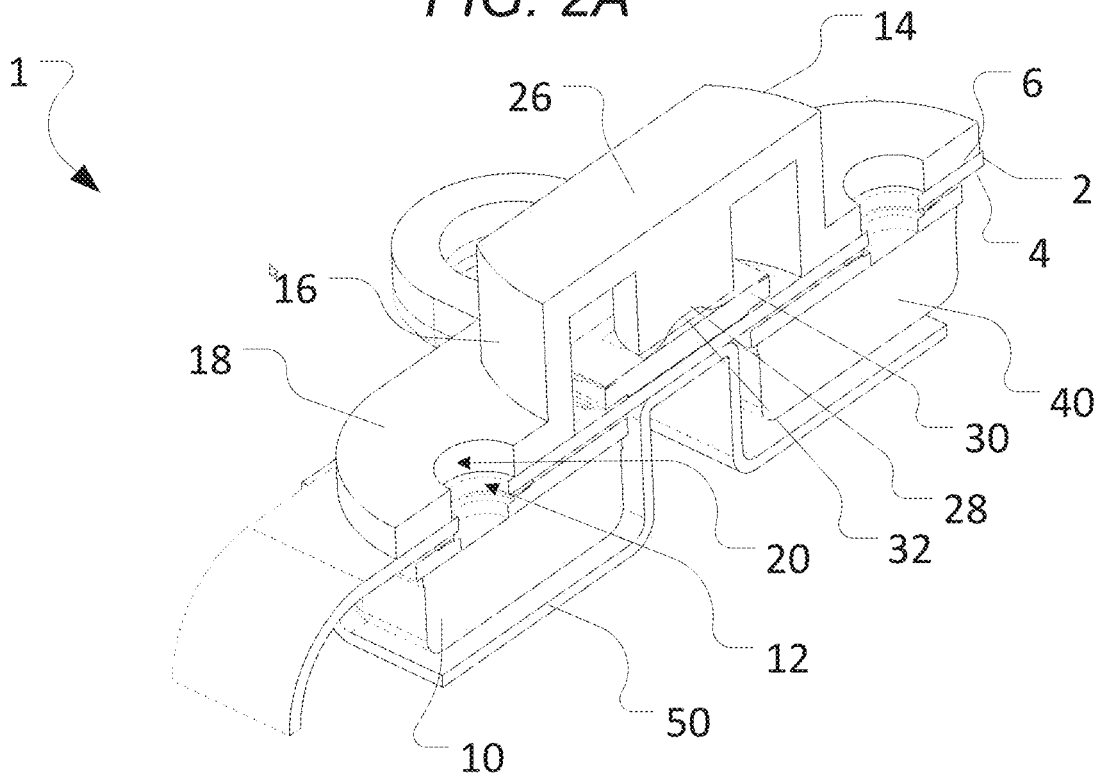
FIG. 2B is a cutaway drawing of the perspective view shown in FIG. 2A.

FIG. 2A shows a perspective view schematically illustrating another embodiment of a compact, watertight and acoustically-tight button structure 1. The same embodiment is shown as a cutaway drawing in FIG. 2B showing more of the features. The embodiment in FIGS. 2A and 2B is in many ways identical to the embodiment shown in FIG. 1 with a difference being the location of the switch component 30. For simplicity, the outer shielding 34 is not shown in FIGS. 2A and 2B.

In FIGS. 2A and 2B the switch component 30 is mounted on the second PCB surface 6 being opposite the first PCB surface 4 on which two microphones 10, 40 are mounted. In the embodiment in FIGS. 2A and 2B the switch component 30 is therefore positioned inside, i.e. surrounded on its sides by, the elastic member 14. The contact surface 28 of the elastic member 14 is arranged such that when a force is applied by a user at the user interface surface 26 of the elastic member 14, the contact surface 28 of the elastic member 14 moves in a direction towards the switch interface surface 32 and, if sufficient force is applied, the contact surface 28 engages with the switch interface surface 32 so as to activate the push-button switch component 30.

In the embodiment in FIGS. 2A and 2B, a frame 50, made of e.g. metal, surrounds the microphones 10, 40. A larger opening, seen behind the main part 16 in the perspective drawings, extending through the frame 50 and the protruding part 18, is an example of how fixation might be achieved. The larger opening, preferably with at least one more identical larger opening, can be utilised to heat solder the frame 50 below the outer shielding 34. Numerous similar solutions are known and a suitable one may be chosen for any one of the embodiments; The important aspect is that the protruding part 18 needs to be under pressure between the outer shielding 34 and the structure underneath the protruding part 18, such as the PCB 2 in the embodiments seen in FIGS. 1, 2A and 2B.

Figure 3A:
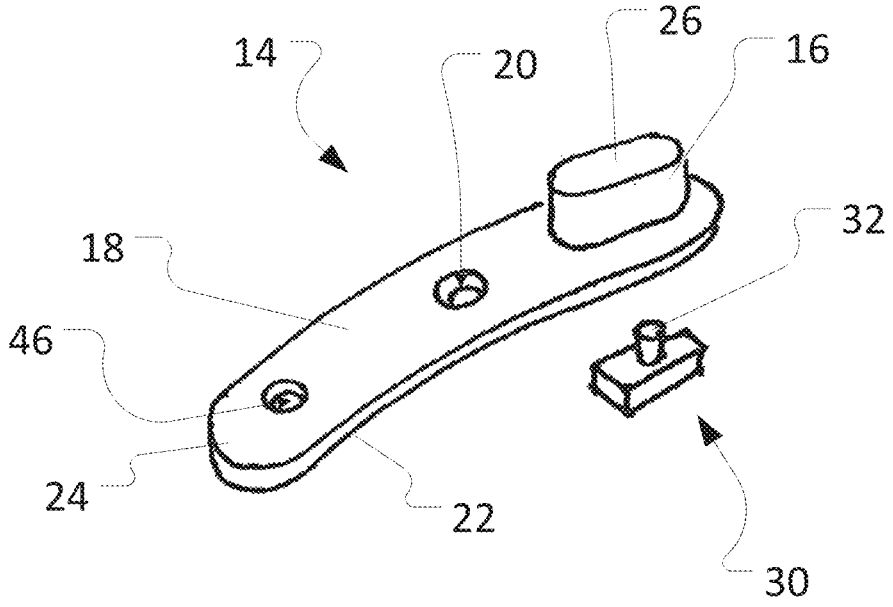
FIGS. 3A and 3B schematically illustrate examples of a combination of a switch component and an elastic member.

FIG. 3A schematically illustrates an example of a combination of a switch component 30 and an elastic member 14 for a compact, watertight and acoustically-tight button structure 1 (entire structure not shown in FIG. 3A).

The elastic member 14 has a main part 16 and a protruding part 18. The protruding part 18 has two microphone openings 20, 46, which in a compact, watertight and acoustically-tight button structure 1 would align with other openings to allow sound to travel to a microphone input via the openings.

The main part 16 is shaped in a cylindrical shape extending from the protruding part 16 and has a user interface surface 26 at a distal end of the cylindrical shape.

A push-button switch component 30 with a switch interface surface 32 would be positioned such that a user can activate the push-button switch component 30 by pushing on the user interface surface 26. This could be achieved by e.g. a contact surface 28, which cannot be seen in FIG. 3A, moving due to the force applied to the user interface surface 26 and if sufficient force is applied the contact surface 28 will, either directly or indirectly, i.e. via an intermediate component, engage with the switch interface surface 32 to activate the switch component 30.

Figure 3B:
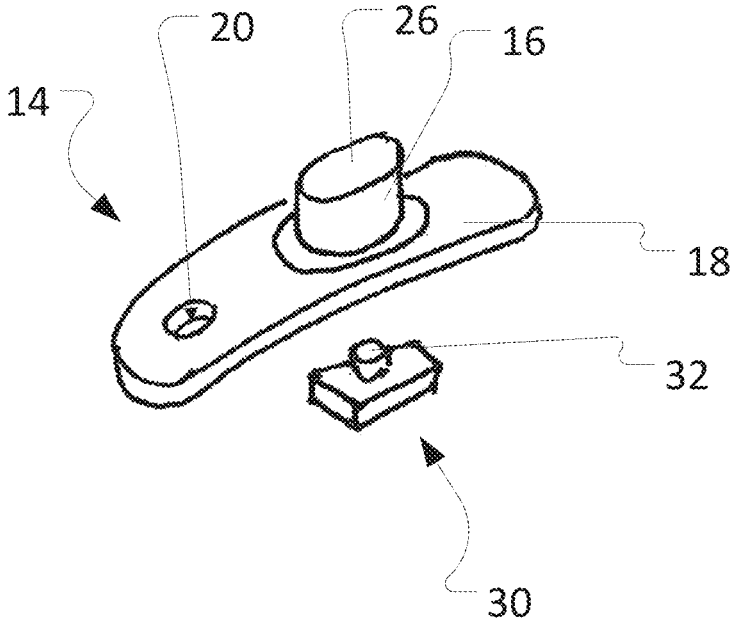

FIG. 3B schematically illustrates another example of a combination of a switch component 30 and an elastic member 14 for a compact, watertight and acoustically-tight button structure 1 (entire structure not shown in FIG. 3B).

The elastic member 14 has a main part 16 and a protruding part 18. The protruding part 18 has a microphone openings 20. In a compact, watertight and acoustically-tight button structure 1 the microphone openings 20 would align with other openings to allow sound to travel to one or more microphone inputs via the openings.

The main part 16 is shaped in a cylindrical shape extending from the protruding part 16 and has a user interface surface 26 at a distal end of the cylindrical shape. The main part 16 is made from a hard plastic material and the protruding part 18 is made from a soft elastomer, the two materials being joined so as to be watertight and acoustically-tight, e.g. by being welded or glued together, together forming the elastic member 14.

The push-button switch component 30 having a switch interface surface 32 is similar to the switch component described with reference to FIG. 3A. To activate the push-button switch component 30, a user will apply force to the user interface surface 26 causing a surface opposite the user interface surface 26 to move and, either directly or indirectly, engage with the switch interface surface 32.

Figure 4A:
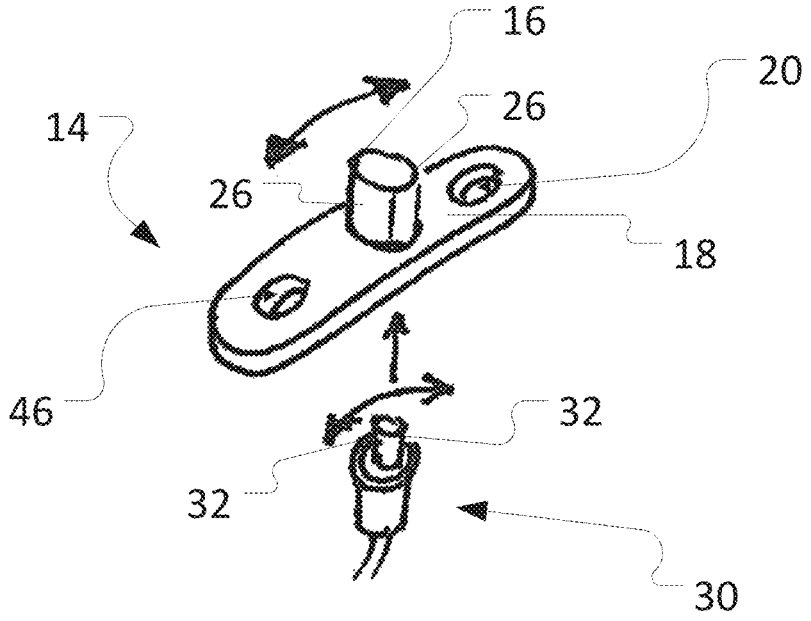
FIGS. 4A and 4B schematically illustrate examples of a combination of a switch component and an elastic member.

FIG. 4A schematically illustrates a further example of a combination of a switch component 30 and an elastic member 14 for a compact, watertight and acoustically-tight button structure 1 (entire structure not shown in FIG. 4A).

The elastic member 14 has a main part 16 and a protruding part 18. The protruding part 18 has two microphone openings 20, 46, which in a compact, watertight and acoustically-tight button structure 1 would align with other openings to allow sound to travel to a microphone input via the openings.

In the example in FIG. 4A, the switch component 30 is a toggle switch, i.e. it comprises an element, a toggle, which can be toggled between two or more positions. Part of the toggle is inserted into and inside the main part 16 of the elastic member 14 as shown by the straight arrow in FIG. 4A. The toggle has two sides, which act as switch interface surfaces 32 and the main part 16 has two corresponding user interface surfaces 26. When the toggle is inserted into the main part 16, it can be engaged by a user pressing on one of the two opposing user interface surfaces 26 thus changing the position of the toggle if sufficient force is applied.

Figure 4B:
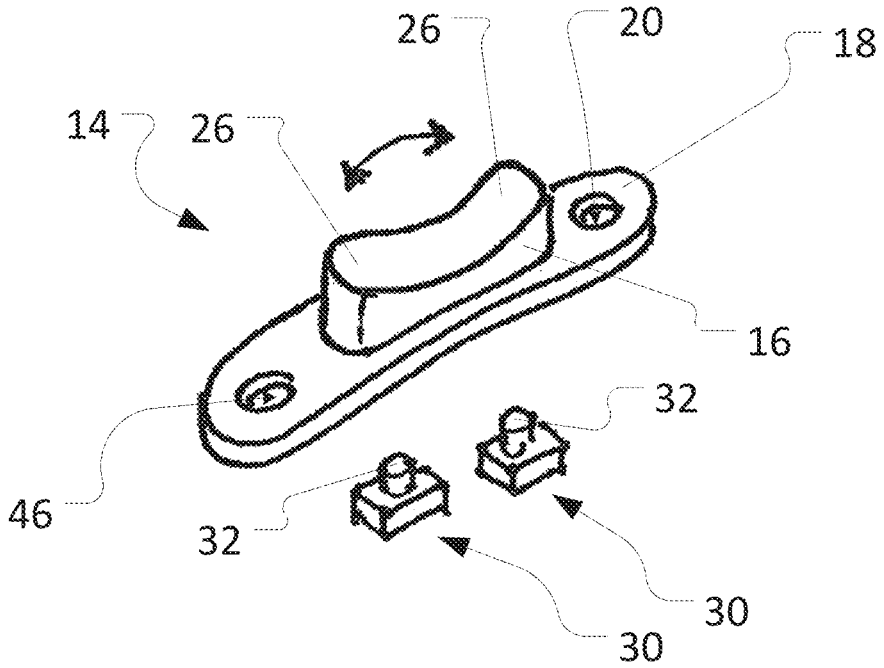

FIG. 4B schematically illustrates an example of a combination of two switch components 30 and an elastic member 14 for a compact, watertight and acoustically-tight button structure 1 suitable for e.g. a volume control (entire structure not shown in FIG. 4B).

The elastic member 14 has a main part 16 and a protruding part 18. The protruding part 18 has two microphone openings 20, 46, which in a compact, watertight and acoustically-tight button structure 1 would align with other openings to allow sound to travel to a microphone input via the openings.

The main part 16 has an elongated shape and two user interface surfaces 26. Two push-button switch components 30 each having a switch interface surface 32 would be positioned such that a user can activate a push-button switch component 30 by pushing on a user interface surface 26 associated with a particular push-button switch component 30. To activate the associated push-button switch component 30, a user will apply force to the associated user interface surface 26 causing a surface opposite the user interface surface 26 to move and, either directly or indirectly, engage with the switch interface surface 32.

The examples of combinations of one or more switch components 30 and an elastic member 14 shown in FIGS. 3A, 4A and 4B all have two openings 20, 46 in the protruding part 18, but this number will depend on the number of microphones in the button structure 1 as each microphone will require an opening to allow sound to travel to its microphone input. Therefore, the button structures could all have one or more openings in the protruding part 18. Alternatively, depending on the design, two or more microphones could share an opening.

Further, the types of buttons illustrated in FIGS. 3A-4B may be combined into a single button structure, such as e.g. a button structure, which has a separate push-button for turning on/off a functionality and two related push-buttons for volume control.

Some preferred embodiments have been shown in the foregoing, but it should be stressed that the claimed invention is not limited to these, but may be embodied in other ways within the subject matter defined in the claims.

In the claims, certain features are described. Some or all of these features may be embodied by one and the same element, component or item. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, elements, steps or components but does not preclude the presence or addition of one or more other features, elements, steps, components or groups thereof.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

LIST OF REFERENCES

1 button structure
2 first printed circuit board (PCB)
4 first PCB surface
6 second PCB surface
8 first microphone
10 first microphone input
12 first microphone PCB opening
14 elastic member
16 main part of elastic member
18 protruding part of elastic member
20 first opening in protruding part
22 first protruding surface
24 second protruding surface
26 user interface surface
28 contact surface
30 switch component
32 switch interface surface
34 outer shielding
36 shield opening
38 second opening
40 second microphone
42 second microphone input
43 third PCB surface
44 second microphone PCB opening
45 second PCB
46 third opening

48 fourth opening
50 frame

The invention claimed is:

1. A button structure for a hearing device, the button structure comprising:

a first microphone, the first microphone being configured to receive sound via a first microphone opening;

an elastic member comprising a first part and a second part, the first part comprising a user interface surface, the second part comprising a first opening, the first opening being aligned with the first microphone opening;

a switch component, wherein the user interface surface of the elastic member is configured to be operated by a user to activate the switch component;

an outer shield comprising a first shield opening and a second shield opening, wherein at least a portion of the first part of the elastic member extends through the first shield opening, wherein the second shield opening of the outer shield is aligned with the first opening of the second part of the elastic member; and a printed circuit board (PCB), wherein the PCB is between at least a portion of the elastic member and the first microphone.

2. The button structure according to claim 1, wherein the outer shield is in contact with the elastic member to create a seal, wherein the seal is watertight and acoustically-tight.

3. The button structure according to claim 1, wherein the switch component is a push-button switch or a toggle switch.

4. The button structure according to claim 1, wherein the first part of the elastic member has a contact surface, the switch component comprising a switch interface surface, and wherein the contact surface of the elastic member is configured to move in a direction towards the switch interface surface in response to an application of force applied by the user at the user interface surface.

5. The button structure according to claim 4, wherein the contact surface is configured to engage the switch interface surface in response to the application of the force.

6. The button structure according to claim 1, wherein the elastic member is made from a soft and compliant elastic material.

7. The button structure according to claim 1, wherein the first part of the elastic member is made of a first elastic material, and the second part of the elastic member is made of a second elastic material, and wherein the first and second elastic materials have different respective properties.

8. The button structure according to claim 1, wherein the first part of the elastic member is made of a first elastic material, and the second part of the elastic member is made of a second elastic material, and wherein the first and second elastic materials have different respective values of hardness.

9. The button structure according to claim 8, wherein the first elastic material has a higher value of hardness than the second elastic material.

10. The button structure according to claim 1, further comprising a second microphone, the second microphone configured to receive sound via a second microphone opening;

wherein the second part of the elastic member has a second opening that it is aligned with the second microphone opening; and wherein the outer shield has a third shield opening that is aligned with the second opening of the second part of the elastic member.

11. The button structure according to claim 1, wherein a cross-sectional dimension of the first opening is anywhere from 0.2 mm to 2 mm.

12. The button structure according to claim 1, wherein the second part of the elastic member is located between the PCB and the outer shield.

13. The button structure according to claim 12, wherein the second part of the elastic member is fixated between the PCB and the outer shield by pressure.

14. A hearing device configured for placement in, or at, an ear of the user, the hearing device comprising the button structure of claim 1.

15. The hearing device according to claim 14, wherein the hearing device is a custom hearing aid.

16. A button structure for a hearing device, the button structure comprising:

a first microphone, the first microphone being configured to receive sound via a first microphone opening;

an elastic member comprising a first part and a second part, the first part comprising a user interface surface, the second part comprising a first opening, the first opening being aligned with the first microphone opening;

a switch component, wherein the user interface surface of the elastic member is configured to be operated by a user to activate the switch component;

an outer shield comprising a first shield opening and a second shield opening, wherein at least a portion of the first part of the elastic member extends through the first shield opening, wherein the second shield opening of the outer shield is aligned with the first opening of the second part of the elastic member; and a printed circuit board (PCB), the PCB comprising a first PCB opening that is aligned with the first microphone opening and the first opening of the second part of the elastic member.

17. The button structure of claim 11, wherein the first microphone is mounted on a first PCB surface of the PCB.

18. The button structure of claim 11, further comprising a second microphone, the second microphone configured to receive sound via a second microphone opening;

wherein the PCB comprises a second PCB opening that is aligned with the second microphone opening.

19. A button structure for a hearing device, the button structure comprising:

a first microphone, the first microphone being configured to receive sound via a first microphone opening;

an elastic member comprising a first part and a second part, the first part comprising a user interface surface, the second part comprising a first opening, the first opening being aligned with the first microphone opening;

a switch component, wherein the user interface surface of the elastic member is configured to be operated by a user to activate the switch component;

an outer shield comprising a first shield opening and a second shield opening, wherein at least a portion of the first part of the elastic member extends through the first shield opening, wherein the second shield opening of the outer shield is aligned with the first opening of the second part of the elastic member; and a printed circuit board (PCB), wherein the first microphone is mounted on a first PCB surface of the PCB, and wherein the switch component is mounted on a second PCB surface of the PCB, the second PCB surface being opposite from the first PCB surface.

20. A button structure for a hearing device, the button structure comprising:

a first microphone, the first microphone being configured to receive sound via a first microphone opening;

an elastic member comprising a single user interface surface or a single row of user interface surfaces, wherein the elastic member comprises a first part and a second part, the first part comprising the single user interface surface or one of the user interface surface in the single row, the second part comprising a first opening, the first opening being aligned with the first microphone opening;

a switch component, wherein the user interface surface of the elastic member is configured to be operated by a user to activate the switch component; and an outer shield comprising a first shield opening and a second shield opening, wherein at least a portion of the first part of the elastic member extends through the first shield opening, wherein the second shield opening of the outer shield is aligned with the first opening of the second part of the elastic member.

21. The button structure according to claim 20, wherein the elastic member comprises a longitudinal axis, and wherein the first part of the elastic member and the first opening of the second part of the elastic member are aligned along the longitudinal axis.

22. The button structure according to claim 20, wherein the longitudinal axis extends through a center part of the elastic member, and corresponds with a long side of the elastic member.

23. The button structure according to claim 20, wherein the outer shield is in contact with the elastic member to create a seal, wherein the seal is watertight and acoustically-tight.

24. The button structure according to claim 20, wherein the switch component comprises a switch interface surface, and wherein a contact surface of the elastic member is configured to move in a direction towards the switch interface surface.

25. The button structure according to claim 24, wherein the contact surface is configured to engage the switch interface surface.

26. The button structure according to claim 20, further comprising a printed circuit board (PCB), the PCB comprising a first PCB opening that is aligned with the first microphone opening.

27. The button structure according to claim 20, wherein the first part of the elastic member is made of a first elastic material, and the second part of the elastic member is made of a second elastic material, and wherein the first and second elastic materials have different respective properties.

28. The button structure according to claim 20, wherein the first part of the elastic member is made of a first elastic material, and the second part of the elastic member is made of a second elastic material, and wherein the first and second elastic materials have different respective values of hardness.

29. The button structure according to claim 28, wherein the first elastic material has a higher value of hardness than the second elastic material.

30. The button structure according to claim 20, further comprising a second microphone, the second microphone configured to receive sound via a second microphone opening;

wherein the second part of the elastic member has a second opening that it is aligned with the second microphone opening; and wherein the outer shield has a third shield opening that is aligned with the second opening of the second part of the elastic member.

31. The button structure according to claim 20, further comprising a printed circuit board (PCB), wherein the second part of the elastic member is located between the PCB and the outer shield.

32. A hearing device configured for placement in, or at, an ear of the user, the hearing device comprising the button structure of claim 20.

33. The hearing device according to claim 32, wherein the hearing device is a custom hearing aid.

* * * * *